US005762430A

United States Patent [19]

Suzuki

[11] Patent Number: 5,762,430

[45] Date of Patent: Jun. 9, 1998

[54] RIBBON CASSETTE

[75] Inventor: Kaneaki Suzuki, Tokyo, Japan

[73] Assignee: NEC Corporation, Tokyo, Japan

[21] Appl. No.: 786,213

[22] Filed: Jan. 21, 1997

[30] Foreign Application Priority Data

Jan. 19, 1996 [JP] Japan ..... 8-007012

[51] Int. Cl.[6] ..... B41J 35/28

[52] U.S. Cl. ..... 400/207; 400/247; 400/248.1

[58] Field of Search ..... 400/208, 208.1, 400/207, 223, 235, 248.1, 247, 248.2, 242, 243

[56] References Cited

U.S. PATENT DOCUMENTS 4,861,177 8/1989 Heins et al. ..... 400/235

5,580,179 12/1996 Abe et al. ..... 400/248.1

5,613,785 3/1997 Yasuoka ..... 400/248.1

FOREIGN PATENT DOCUMENTS 60-193681 10/1985 Japan .

*Primary Examiner*—John S. Hilten

*Attorney, Agent, or Firm*—Sughrue, Mion, Zinn, Macpeak & Seas, PLLC

[57] ABSTRACT

A ribbon cassette has an ink ribbon; a case; a cover coupled to the case by hinge pins, the cover being freely opened or closed through hinge pins; a drive roller in contact with the ink ribbon for running the ink ribbon; a follower roller for pressing the ink ribbon against the drive roller a holder for holding the follower roller; and a spring for biasing the follower roller against the drive roller via the holder. The holder is further provided with hook parts, and the cover has protruding pieces which engage with the hook parts of the holder and thereby move the holder away from the drive roller to detach the follower roller from the drive roller.

11 Claims, 5 Drawing Sheets

RIBBON CASSETTE

BACKGROUND OF THE INVENTION

1. Field of the Invention

The present invention relates to a ribbon cassette, and more particularly to a ribbon cassette housing an ink ribbon which is to be replaced by an operator.

2. Description of the Related Art

When an ink ribbon in a ribbon cassette has worn out, an operator replaces it. When the ink ribbon in this kind of ribbon cassette is to be replaced, the operator removes the old ribbon from the ribbon cassette along the threading path within the ribbon cassette by handling it with a pair of tweezers or the like. At a drive roller for running the ink ribbon, usually a follower roller is pressed against the drive roller with the ink ribbon in-between, and the operator has to remove the ink ribbon while keeping the two rollers away from each other by pulling the holder of the follower roller against the force biasing the follower in the direction of the drive roller. When a new ribbon is to be fitted into the ribbon cassette, the operator sets and holds by hand a box or the like housing the ink ribbon within the ribbon cassette while exposing a part of the ribbon from the box, and, after this, pulls out the exposed part of the ink ribbon with tweezers or the like. When the ribbon is to be inserted between the two rollers, as when the old ribbon is to be removed, the operator has to insert the ink ribbon with tweezers or the like while keeping the two rollers away from each other by pulling the holder of the follower roller against the biasing force.

Thus, ink ribbon replacement is a troublesome job because of handling the ink ribbon with tweezers or the like while keeping the rollers away from each other. Moreover, during replacement, the operator is required to touch the rollers directly by hand, thereby smearing the hand with the ink sticking to the rollers.

On the other hand the Gazette of the Japanese Patent Laid-Open No. Sho 60(1985)-193681 discloses a ribbon cassette which, when the ink ribbon is to be replaced, allows the gap between two rollers to be held apart without requiring the operator to touch them by hand. In this prior art ribbon cassette, a manipulator is connected to a supporting body to support the follower roller so that the operator can bring the follower roller away from the drive roller with the manipulator, and maintain the drive roller and the follower roller kept away from each other by engaging the supporting body or the manipulator with an engaging section provided on the cassette case with the result that the operator can readily replace the ink ribbon without having to touch the rollers by hand.

However, as the manipulator protrudes outside the cassette case such that it may not be smeared with ink and, since the protruding section has to be large enough to be manipulated by hand, some space is needed around the ribbon cassette resulting in the restriction of the freedom of the arrangement of constituent parts around the ribbon cassette.

Furthermore, the operator, in order to bring the follower roller away from the drive roller, should handle the manipulator in addition to opening the cassette cover.

SUMMARY OF THE INVENTION

An object of the present invention is to provide a ribbon cassette in which the replacement of the ink ribbon is facilitated by an arrangement in which the rollers are detached from each other by the operator upon opening a cassette cover.

Another object of the invention is to provide a ribbon cassette which is free from the risk that the operator may inadvertently touch any roller and thereby smear his or her hand with ink.

Still another object of the invention is to provide a ribbon cassette which does not need any manipulator protruding from the ribbon cassette.

According to the invention, there is provided a ribbon cassette having an ink ribbon; a case; a cover coupled to the case by hinge pins, the cover being freely opened and closed through hinge pins; a drive roller, in contact with the ink ribbon, for running the ink ribbon; a follower roller which presses the ink ribbon against the drive roller a holder for supporting the follower roller; a spring for biasing the follower roller against the drive roller via the holder; hook parts provided on the holder; and protruding pieces which provided on the cover, engage the hook parts of the holder only when the cover is open to move the holder against the biasing force of the spring.

By virtue of this configuration, in the ribbon cassette according to the invention, a gap is formed between the follower and drive rollers only by the opening action of the cassette cover, so that the operator can readily replace the ink ribbon without having to touch either roller and getting his or her hand smeared, and without requiring a manipulator protruding from the cassette case.

BRIEF DESCRIPTION OF THE DRAWINGS

The above-mentioned and other objects, features and advantages of the present invention will become more apparent from the following detailed description when taken in conjunction with the accompanying drawings, wherein.

DETAILED DESCRIPTION OF THE PREFERRED EMBODIMENT

Next will be described a preferred embodiment of the invention in detail with reference to the drawings.

Figure 1:
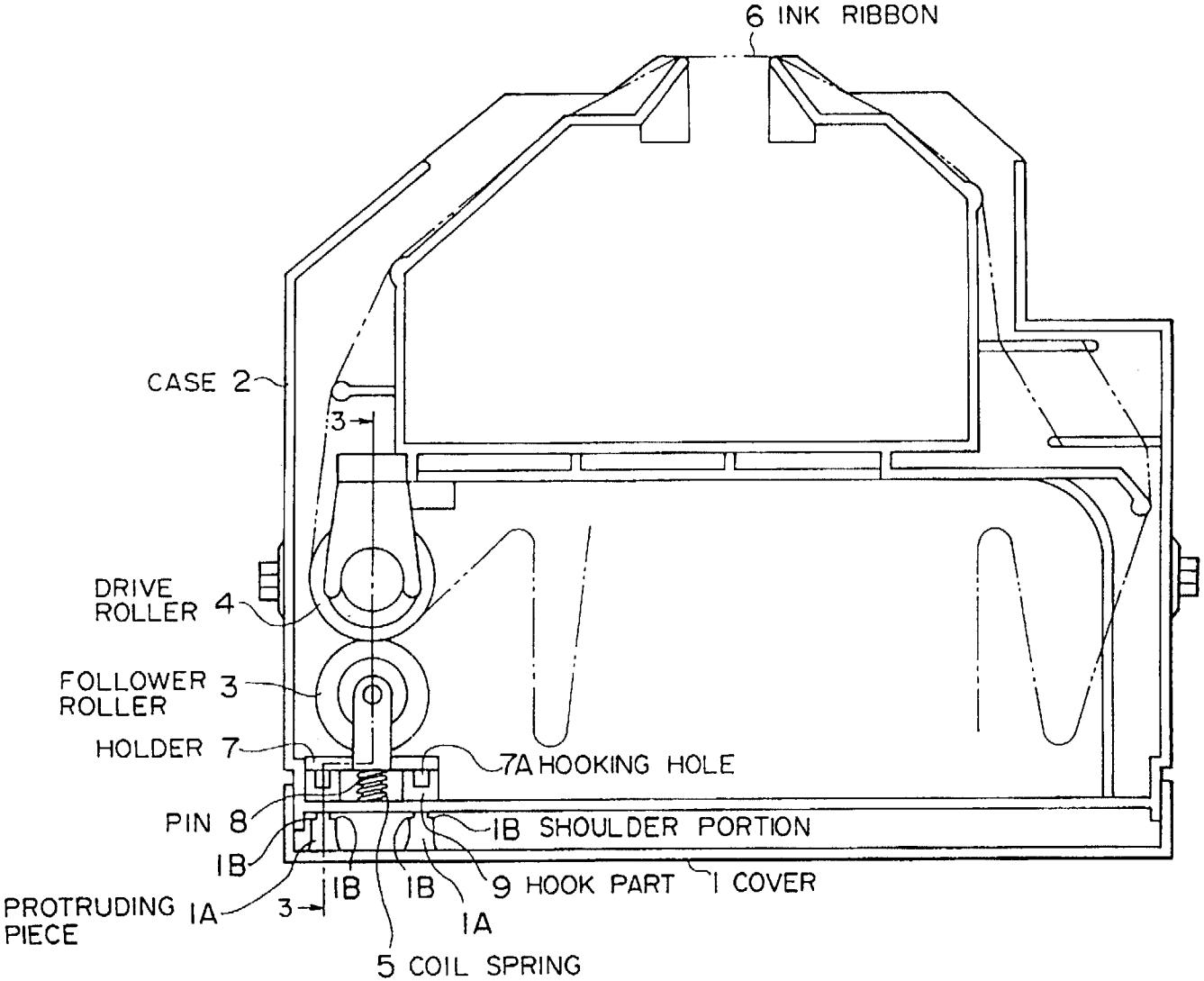
FIG. 1 shows a plan view of a ribbon cassette in a preferred embodiment of the invention.
Figure 2:
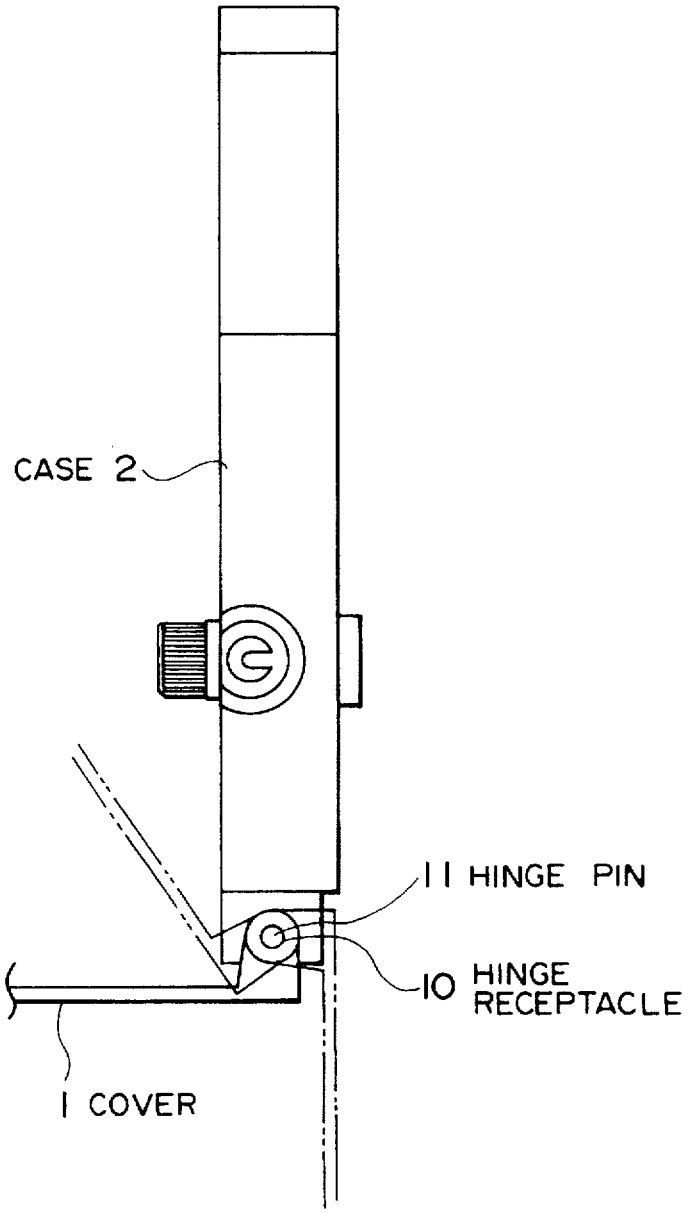
FIG. 2 shows a profile of the ribbon cassette illustrated in FIG. 1.
Figure 3:
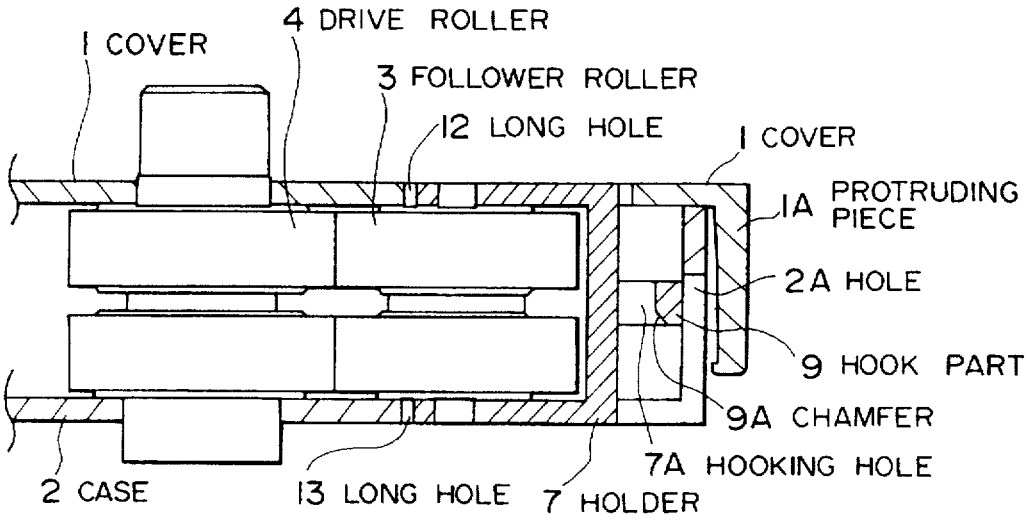
FIG. 3 shows an a cross section of FIG. 1 in the closed state of the cover.
Figure 5:
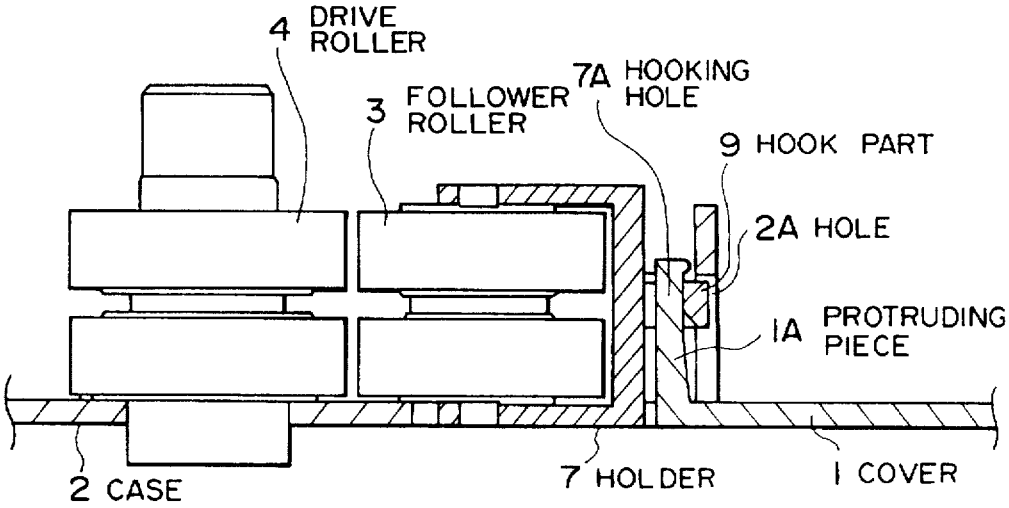
FIG. 5 shows an a cross section of FIG. 1 in the fully open state of the cover.
Figure 6:
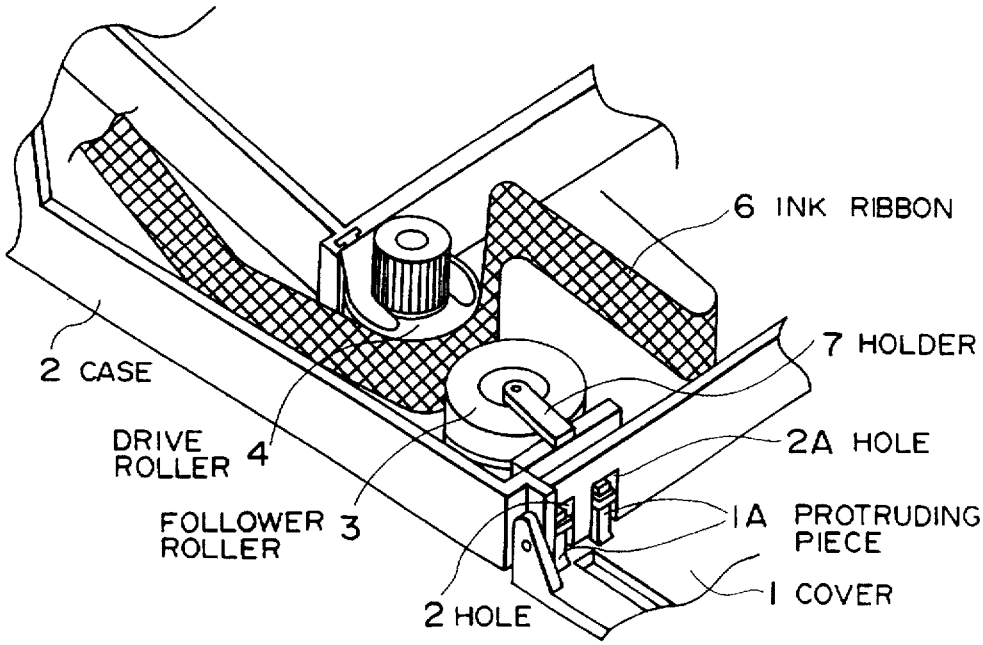
FIG. 6 shows a partial perspective view of the ribbon cassette illustrated in FIG. 1.
Figure 7:
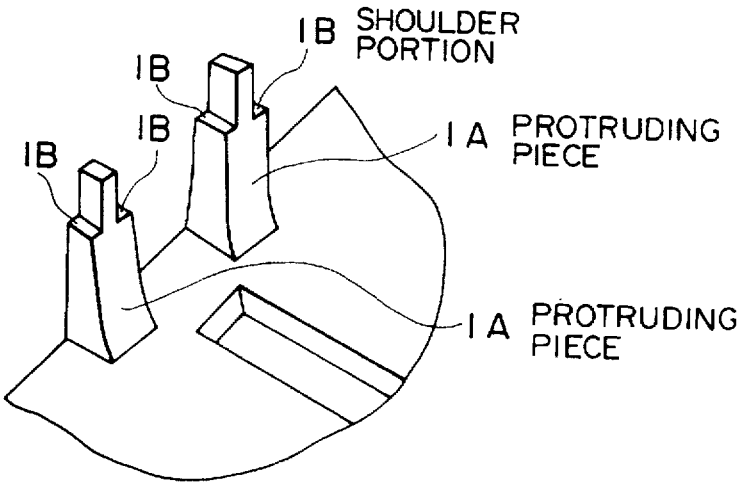
FIG. 7 shows a perspective view of protruding pieces pertaining to the invention.

FIG. 1 shows a plan of a ribbon cassette, which is the preferred embodiment of the invention; FIG. 2 shows a profile of FIG. 1; and FIGS. 3 through 5 respectively show an a cross section of FIG. 1 in the closed, half open and fully open states of the cover, respectively. FIG. 6 further shows a partial perspective view of the ribbon cassette illustrated in FIG. 1.

Referring to the diagrams, the ribbon cassette includes a case 2 for housing an ink ribbon 6 among other things and, fitted to the case 2, a cover 1 which can be freely opened or closed. The case 2 has, in addition to the ink ribbon 6, a freely rotatable drive roller 4, a follower roller 3 which can freely move toward or away from the drive roller 4, and a holder 7 holding the follower roller 3 fully rotatable around a shaft. At the two ends of the case 2 are provided hinge pins 11 as illustrated in FIG. 2, and at the two ends of the cover 1 are arranged hinge receptacles 10, so that the cover 1 can be freely opened or closed around the hinge pins 11.

In the cover 1 and the case 2 are bored long holes 12 and 13, respectively, and the holder 7 can move along these long holes toward the drive roller 4. On the face of the holder 7 opposite to than where the follower roller 3 is disposed, two U-shaped hook parts 9 are formed each having a hooking hole 7A, and a pin 8, the pin 8 being positioned between the two hook parts 9. The pin 8 is contained in a coil spring 5, which presses the holder 7 against the drive roller 4 and forces the follower roller 3 into contact with the drive roller 4.

Protruding pieces 1A are arranged upright on the cover 1 in positions meeting the hook parts 9 and near the center of the rotation of the hinge pins 11. The protruding pieces 1A are arranged in a direction normal to the surface of the cover 2. The protruding faces 1A, when the cover 1 closes the case 2, keep their tips out of the hooking holes 7A of the hook parts 9 (FIG. 3); when the cover 1 is half opened around the hinge pins 11, let their tips enter the hooking holes 7A (FIG. 4); and, when the cover 1 is further opened, move the holder 7 away from the drive roller 4 while engaging with the hook parts 9 (FIG. 5).

Figure 4:
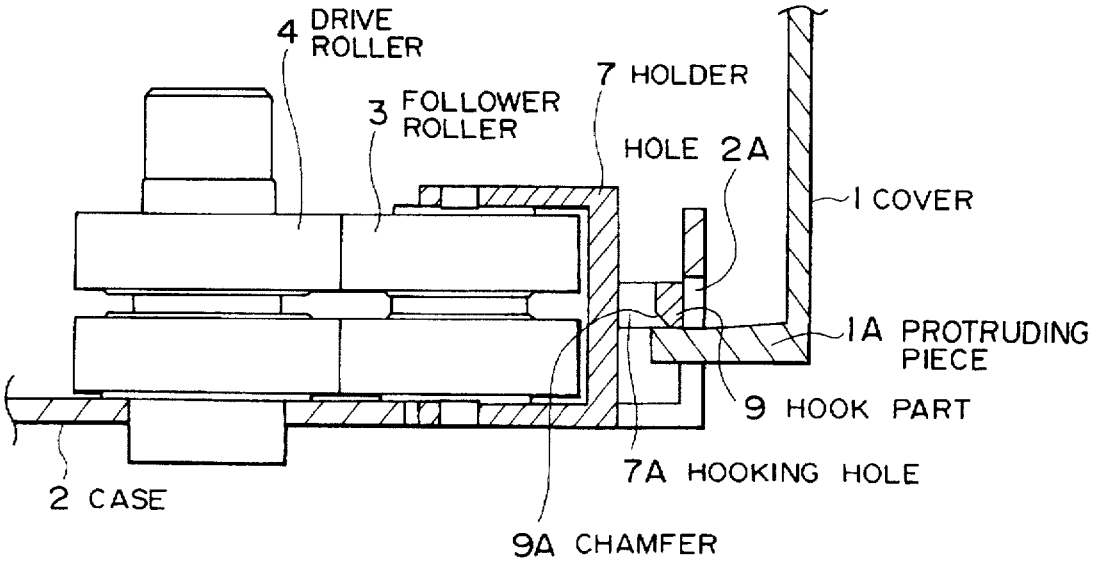
FIG. 4 shows an a cross section of FIG. 1 in the half open state of the cover.

The corners of the hook parts 9 close to where the protruding pieces 1A enter are chamfered (9A) as shown in FIG. 4, and these chamfer 9A lead the protruding pieces 1A securely into the hook parts 9.

When the cover 1 is opened to replace the ribbon, the holder 7 is moved by the protruding pieces 1A of the cover 1, and the hook parts 9 engage with holes 2A bored in the case 2. Each of the protruding pieces 1A has shoulder portions 1B, beyond which the hooking hole 7A does not permit entry. This configuration enables the hook parts 9 of the holder 7 to engage with the holes 2A of the case 2 when the cover 1 is opened, and to be upheld from underneath by the shoulder portions 1B of the protruding pieces 1A so that the follower roller 3 may not come off when the ribbon is being replaced.

Since the protruding pieces 1A of the cover 1 are not inserted into the hooking holes 7A of the holder 7 when the case 2 is closed with the cover 1, the holder 7 is pressed by the coil spring 5 and the follower roller 3 is pressed against the drive roller 4 with the ink ribbon 6 in-between, so that the drive roller 4 can run the ink ribbon 6.

Furthermore the operator, when the ink ribbon 6 is to be replaced, opens the cover 1, which rotates around the hinge pins 11. This action causes the tips of the protruding pieces 1A of the cover 1 to enter into the hooking holes 7A of the holder 7 and, as the cover 1 is further opened, the tips engage with the hooking holes 7A to move the holder 7 away from the drive roller 4. Accordingly, the follower roller 3 moves away from the follower roller to create a gap between the two rollers.

The operator first disengages with tweezers or the like the old ink ribbon from between the rollers kept away from each other, and removes the old ink ribbon from the ribbon cassette. Then he or she puts a new ink ribbon package into the ribbon cassette, pulls out the ink ribbon with tweezers or the like, and threads it between the rollers kept away from each other and along the rest of its path. Thus, the operator need not use his or her hands to hold the roller apart when inserting the ink ribbon.

Figure 8:
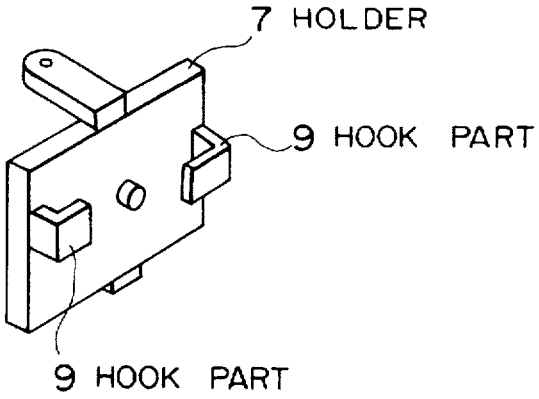
FIG. 8 is a perspective view of a holder, whose hook parts are L-shaped, pertaining to the invention.

In an embodiment of the present invention, the hook parts 9 of the holder 7 may be in any shape as long as they allow engagement with the protruding pieces 1A, for instance L-shaped as illustrated in FIG. 8.

What is claimed is:

1. An ink ribbon cassette comprising:

a case;

an ink ribbon disposed within said case;

a cover coupled to said case by hinge pins, said cover being freely opened or closed through said hinge pins;

a fixed supporting member in contact with the ink ribbon;

a movable supporting member for pressing the ink ribbon against said fixed supporting member; and moving means for moving said movable supporting member towards and away from said fixed supporting member in response to the respective closing and opening of said cover.

2. An ink ribbon cassette as recited in claim 1, wherein said moving means comprises:

a holder for movably supporting said movable supporting member;

hook parts provided on said holder; and protruding pieces provided on said cover for engaging said hook parts and moving said holder upon opening said cover.

3. An ink ribbon cassette as recited in claim 2, wherein:

said movable supporting member is disposed on a side of said holder, said hook parts are disposed on an opposite side of said holder, and said protruding pieces slidably engage said hook parts upon opening said cover.

4. An ink ribbon cassette as recited in claim 2, wherein:

said case includes holes for receiving said protruding pieces upon opening said cover, and said protruding pieces include shoulder portions for supporting said hook parts.

5. An ink ribbon cassette as recited in claim 2, wherein said hook parts have U-shaped portions for engaging with said protruding pieces.

6. An ink ribbon cassette as recited in claim 2, wherein said hook parts have L-shaped portions for engaging with said protruding pieces.

7. An ink ribbon cassette as recited in claim 2, wherein said hook parts are chamfered where said protruding pieces slidably engage with said hook parts.

8. An ink ribbon cassette comprising:

a case;

an ink ribbon disposed within said case;

a cover coupled to said case by hinge pins, said cover being freely opened or closed through said hinge pins;

a fixed supporting member in contact with the ink ribbon;

a movable supporting member for pressing the ink ribbon against said fixed supporting member;

a holder for movably supporting said movable supporting member;

pressing means for pressing said movable supporting member against said fixed supporting member;

hook parts provided on said holder; and protruding pieces provided on said cover, said protruding pieces engaging said hook parts and said protruding pieces moving said holder upon opening said cover.

9. An ink ribbon cassette as recited in claim 8, wherein said protruding pieces and said hook parts are provided in a plurality of sets.

10. An ink ribbon cassette as recited in claim 8, wherein:

said movable supporting member is disposed on a first side of said holder facing said fixed supporting member, said hook parts are disposed on a second side of said holder opposite the first side, and said pressing means is disposed on the second side of said holder between said hook parts.

11. An ink ribbon cassette comprising:

a case;

an ink ribbon disposed within said case;

a cover coupled to said case by hinge pins, said cover being freely opened or closed through said hinge pins;

a drive roller in contact with the ink ribbon for running the ink ribbon;

a follower roller for pressing the ink ribbon against said drive roller;

a holder for movably supporting said follower roller;

a spring for biasing said follower roller in the direction of said drive roller;

hook parts provided on said holder; and protruding pieces provided on said cover said protruding pieces engaging said hook parts said protruding pieces moving said holder in the direction against the spring bias upon opening said cover.

* * * * *